US008312676B2

(12) United States Patent
Maciulewicz

(10) Patent No.: US 8,312,676 B2
(45) Date of Patent: Nov. 20, 2012

(54) SHUTTER PANEL HAVING LOUVERS ALIGNED ALONG A SINGLE PLANE

(76) Inventor: Peter Scott Maciulewicz, Auburn, NY (US)

( * ) Notice: Subject to any disclaimer, the term of this patent is extended or adjusted under 35 U.S.C. 154(b) by 202 days.

(21) Appl. No.: 12/694,871

(22) Filed: Jan. 27, 2010

(65) Prior Publication Data

US 2010/0263282 A1 Oct. 21, 2010

Related U.S. Application Data

(60) Provisional application No. 61/169,463, filed on Apr. 15, 2009.

(51) Int. Cl.
*E06B 7/08* (2006.01)

(52) U.S. Cl. ..... 49/74.1; 49/403; 49/86.1; 49/92.1; 40/503; 40/492; 40/493

(58) Field of Classification Search ..... 49/74.1, 49/403, 82.1, 86.1, 92.1, 73, 77.1, 79.1, 80.1, 49/81.1; 40/503, 492, 493, 473
See application file for complete search history.

(56) References Cited

U.S. PATENT DOCUMENTS 2,952,882 A * 9/1960 Reynaud ..... 49/249
3,156,956 A * 11/1964 Jacobson ..... 49/87.1
3,205,541 A * 9/1965 Beards ..... 49/371
3,284,951 A * 11/1966 Shapiro ..... 49/74.1
3,885,347 A * 5/1975 Adachi et al. ..... 49/91.1
3,919,794 A * 11/1975 Hunter, Jr. ..... 40/470
4,014,253 A * 3/1977 Dry ..... 454/313
4,294,283 A * 10/1981 Scharres ..... 137/599.02
5,765,307 A * 6/1998 Grimes ..... 49/77.1
5,794,380 A * 8/1998 Guardia ..... 49/74.1
6,098,340 A * 8/2000 Francis ..... 49/74.1
6,675,534 B2 * 1/2004 Marocco ..... 49/86.1
6,810,621 B1 * 11/2004 Ricci ..... 49/90.1
7,921,586 B2 * 4/2011 Reynolds et al. ..... 40/505

FOREIGN PATENT DOCUMENTS

JP 52026744 A * 2/1977

* cited by examiner

*Primary Examiner* — Jerry Redman
(74) *Attorney, Agent, or Firm* — David L. Nocilly; Bond, Schoeneck & King, PLLC

(57) ABSTRACT

A shutter panel having multiple louvers that may be opened or closed in unison and which provide a flat, non-overlapping surface when placed in the closed position. Each louver is provided with a pivot post and a drive post, and the drive posts of each louver are interconnected to one or more control rods hidden within the stiles of the shutter panel. Each louver is beveled to encourage movement between the open and closed positions, and to assist with the formation of a substantially flat surface when the louvers are placed in the closed positions. The substantially flat surface formed when the louvers are closed may include an aesthetic design applied thereon or engraved therein.

6 Claims, 12 Drawing Sheets

SHUTTER PANEL HAVING LOUVERS ALIGNED ALONG A SINGLE PLANE

The present invention claimed priority to U.S. Provisional Application No. 61/169,463, filed Apr. 15, 2009.

BACKGROUND OF THE INVENTION

1. Field of the Invention

The present invention relates to shutter panels and, more particularly, to a shutter panel that may be closed into a position where each of a plurality of louvers are coplanar and non-overlapping.

2. Description of the Related Art

Adjustable blinds and the like are often used in homes and commercial locations to reduce the amount of sunlight that enters a particular room through a window or other opening, or to provide privacy by obscuring the view through the window or opening. Conventional blinds comprise one or more panels, each of which includes a series of vertically or horizontally extending louvers or slats that may be moved between a open position, where the louvers are positioned in parallel with respect to each other, and a closed position, wherein each louver overlaps an adjacent louver to form a barrier with respect to the passage of light.

One conventional form of shutter generally comprises a series of wooden louvers extending horizontally and capable of pivot movement between an open position and a closed position, where the louvers are overlapping. The louvers are also interconnected to each along an intermediate portion thereof by a single, vertically extending rod positioned on one side of the shutter. The shutters may be opened or closed in unison when a user moves the rod upwards or downwards. These shutters are relatively ungainly in appearance, however, due to the need for an external rod and the overlapping of the louvers when the shutter is in a closed position.

BRIEF SUMMARY OF THE INVENTION

It is therefore a principal object and advantage of the present invention to provide a shutter having louvers aligned along a single plane.

It is an additional object and advantage of the present invention to provide a shutter having louvers that present a smooth surface when placed in the closed position.

It is a further object and advantage of the present invention to provide a shutter having louvers that may be provided with an attractive design.

In accordance with the foregoing objects and advantages, the present invention provides a shutter panel having a plurality of louvers may be closed into a uniform plane without any overlapping of edges, thereby providing an aesthetically pleasing design. Each louver of shutter panel a first post interconnected thereto for providing a pivot point and a second post positioned off-center with respect to first post for providing a motive force. The second posts of each louver are interconnected to each other by one or more control rods positioned with a cavity formed in the vertically extending stiles of the shutter panel. When any louver is pivoted, the control rod transmits the force to each other louver for movement in unison. Each louver is beveled to encourage movement between the open and closed positions and assist in the formation of a substantially flat surface when the shutter is closed.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
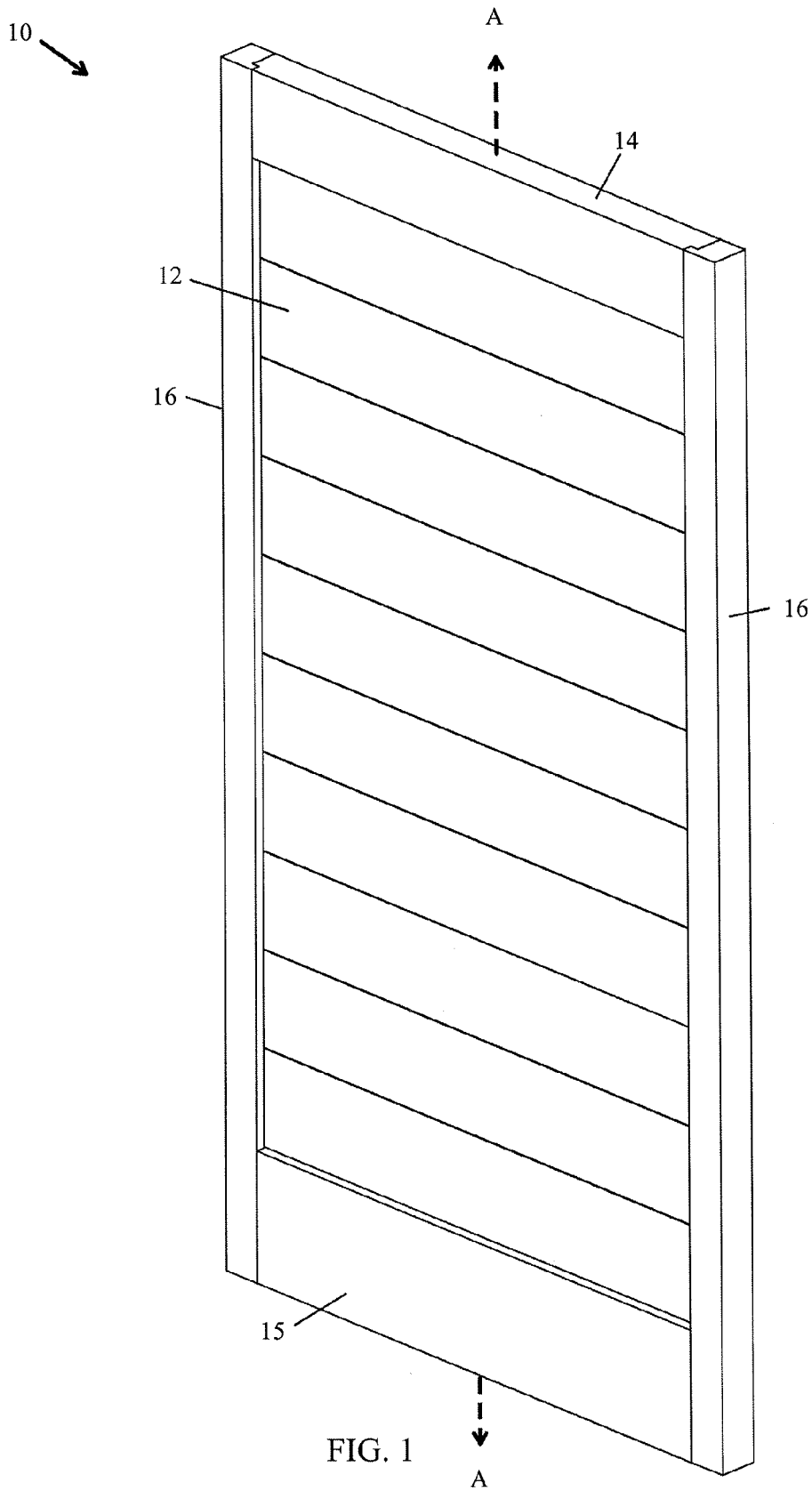
FIG. 1 is a perspective view of a shutter according to the present invention in the closed position.
Figure 2:
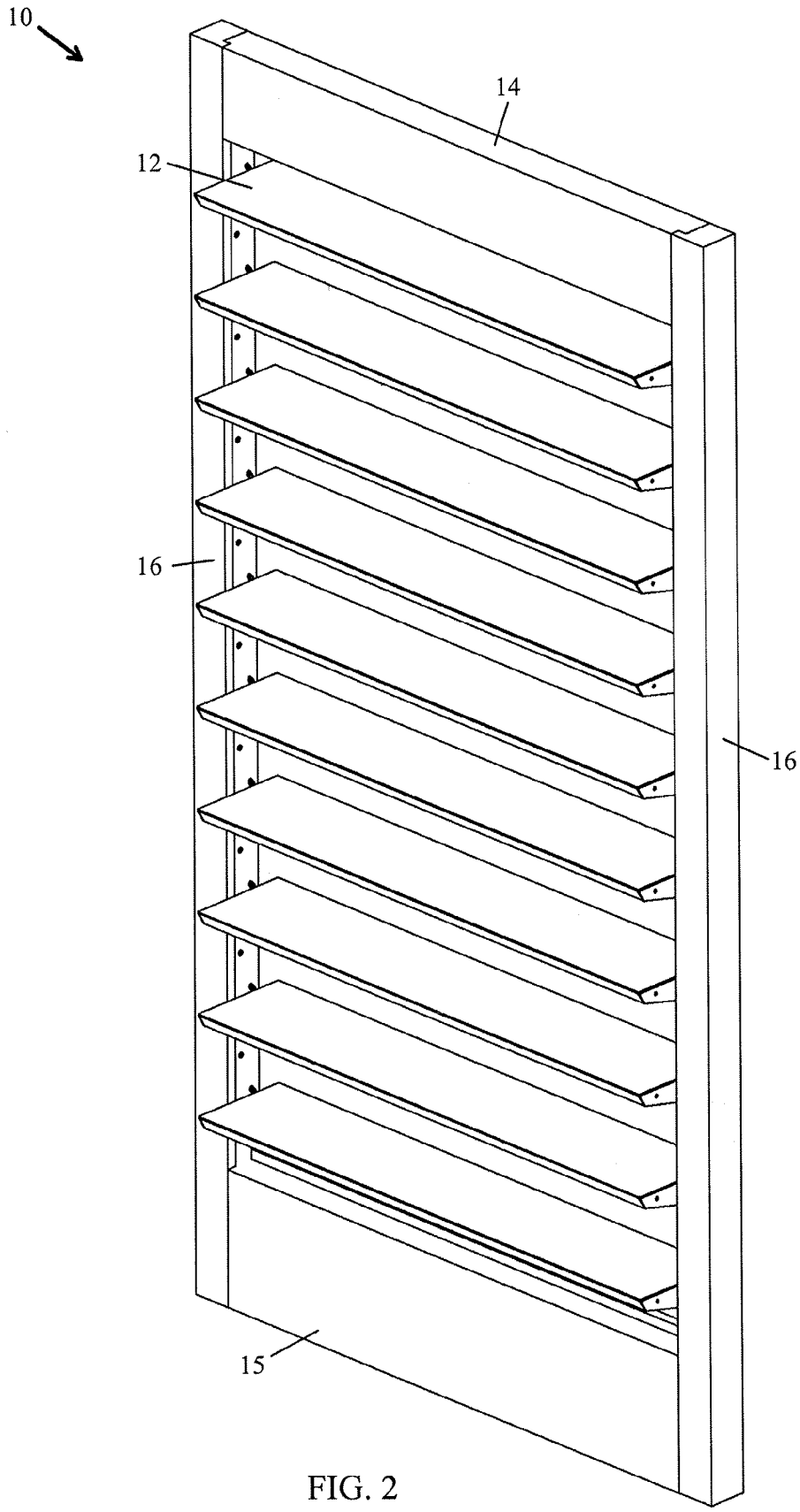
FIG. 2 is a perspective view of a shutter according to the present invention in the open position.

Referring now to the drawings, wherein like reference numerals refer to like parts throughout, there is seen in FIG. 1 a shutter 10 comprising a series of louvers 12 according to the present invention. Shutter 10 is in the closed position, where each louver 12 extends along a common plane A-A and presents a substantially flat surface without any overlapping of adjacent louvers 12 as with conventional designs. Shutter 10 further comprises a top rail 14 and a bottom rail 15, both of which extend horizontally between two, spaced apart vertical stiles 16. Similarly, louvers 12 also extend horizontally between stiles 16 and are attached thereto for pivotal movement, as will be described in detail herein. As seen in FIG. 2, louvers 12 may be pivoted to open shutter 10 to allow light to pass through. Noticeably absent from shutter 10 is any external rod for movement of the louvers 12, or any overlapping of adjacent louvers 12, as a result of the positioning one or two driving mechanisms interiorly of shutter 10 and preferably entirely within stile 16, as will be described in more detail hereinafter.

Figure 3:
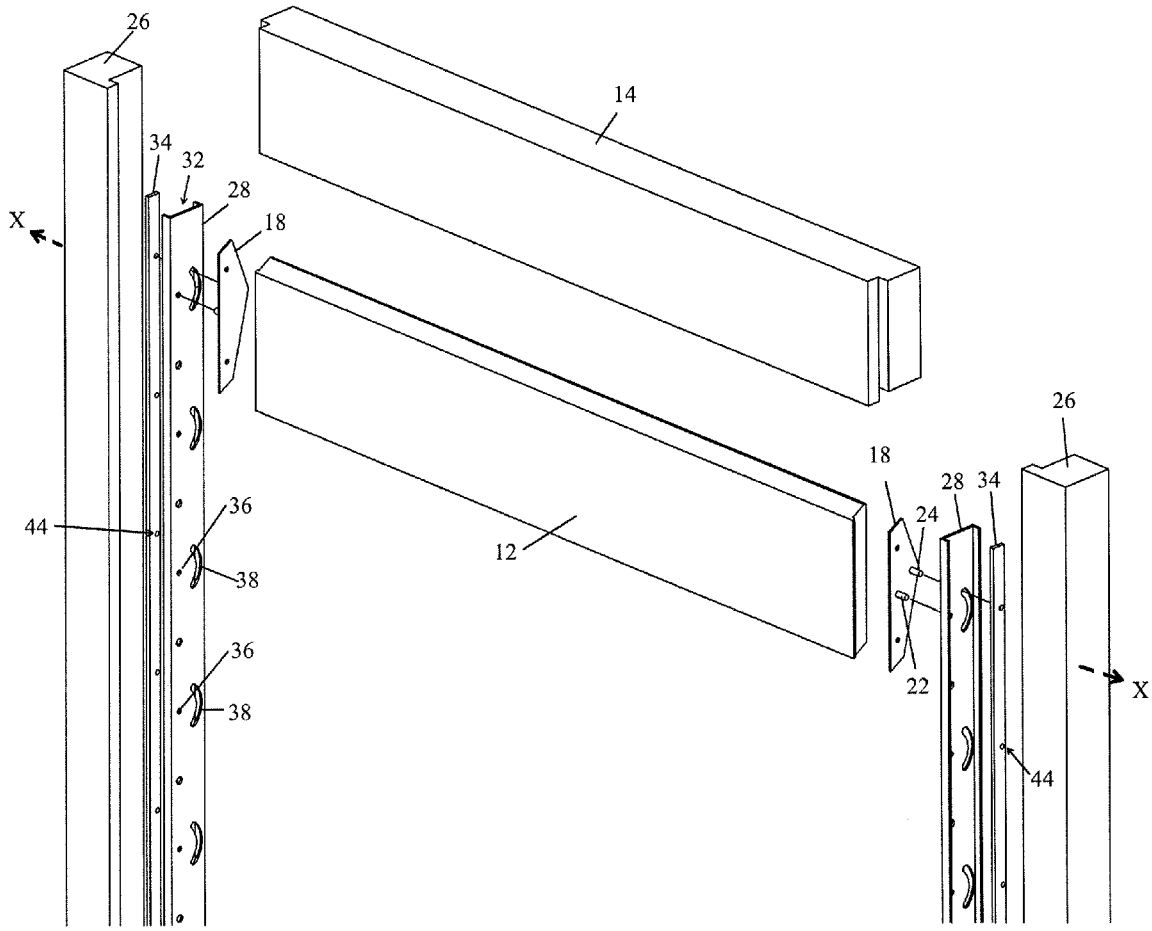
FIG. 3 is an exploded, perspective view of a shutter according to the present invention.

Referring to FIG. 3, each louver 12 includes an end cap 18 affixed at either end that has first and second posts 22 and 24 extending outwardly therefrom. End caps 18 may be fabricated from metal, such as by stamping, and affixed to louver 12 using fasteners or glue. Each stile 16 comprises an elongated body 26, a U-shaped bracket 28 extending along the length of the interior portion of body 26 to define an elongated cavity 32 therein, and a control rod 34 positioned in cavity 32 for vertical movement within cavity 32. Control rod 34 may be manufactured from wood, metal, or even a composite material, such as fiberglass, for added rigidity, particular if needed for controlling a large number of louvers 12.

Bracket 28 further includes a set of holes 36, each of which is positioned to receive first post 22 of each louver 12, and a set of arcuate slots 38, each of which is positioned to receive second post 24 of each louver 12. First post 22 of cap 18 is aligned along the axis of rotation X-X of the louver 12 with which it is associated and with one hole 36 of bracket 28 so that first post 22 will be positioned in hole 36 when shutter 10 is assembled to provide a point of rotation along axis X-X. Second post 24 of each cap 18 is positioned off-center with respect to the axis of rotation X-X of the louver 12 with which it is associated and in alignment with one of the arcuate slots 38 of bracket 28 such that second post 24 will be positioned in arcuate slot 38 when shutter 10 is assembled.

As further seen in FIG. 3, second post 24 extends through arcuate slot 38 to engage control rod 34. Preferably, second post 24 is affixed to rod 34 in a manner that allows post 24 to rotate relative to rod 34, such as by allowing post 24 to pass through holes 44 formed through rod 34. Post 22 thus provides a fixed pivot point for louver 12, and second post 24 interconnects all of the louvers 12 in shutter 10 so that they will move between open and closed positions in unison, with second post 24 of each louver 12 traveling in arcuate slot 38 as louver 12 pivots about axis X-X. The pivot range of shutter 10 is governed by the length of arcuate slot 38. Due to the fact that second post 24 is off-center with respect to the pivot axis of louver 12, vertical movement of control rod 34 will provide a rotational force to each louver 12 to accomplish movement between the open and closed positions via second posts 24. Preferably, each stile 16 may be provided with control rod 34, but it should be recognized by those of skill that only one control rod 34 is required for movement of louvers 12 in unison.

Stiles 16 are notched to form a lap or rabbet joint which accepts bracket 28 therein and engages correspondingly notched top rail 14 once louvers 14 are positioned with first post 22 and second post 24 extending through hole 36 and arcuate slot 38, respectively. Control rods 34 may optionally be interconnected to an external handle (not shown) that may be employed by a user to open and close shutter 10, or a user may simply apply a force directly to one louver 12 to open and close all louvers 12 of shutter 10. Alternatively, one or both control rods 34 may be interconnected to an electric motor or servo positioned inside stile 16 or discretely on the outside of shutter 10 for electronic control of louvers 14. For example, louvers 14 could be controlled by a user via a remote control that transmits to a motor for driving one or both control rods 34, or even through a home or internet based wireless network.

Figure 4:
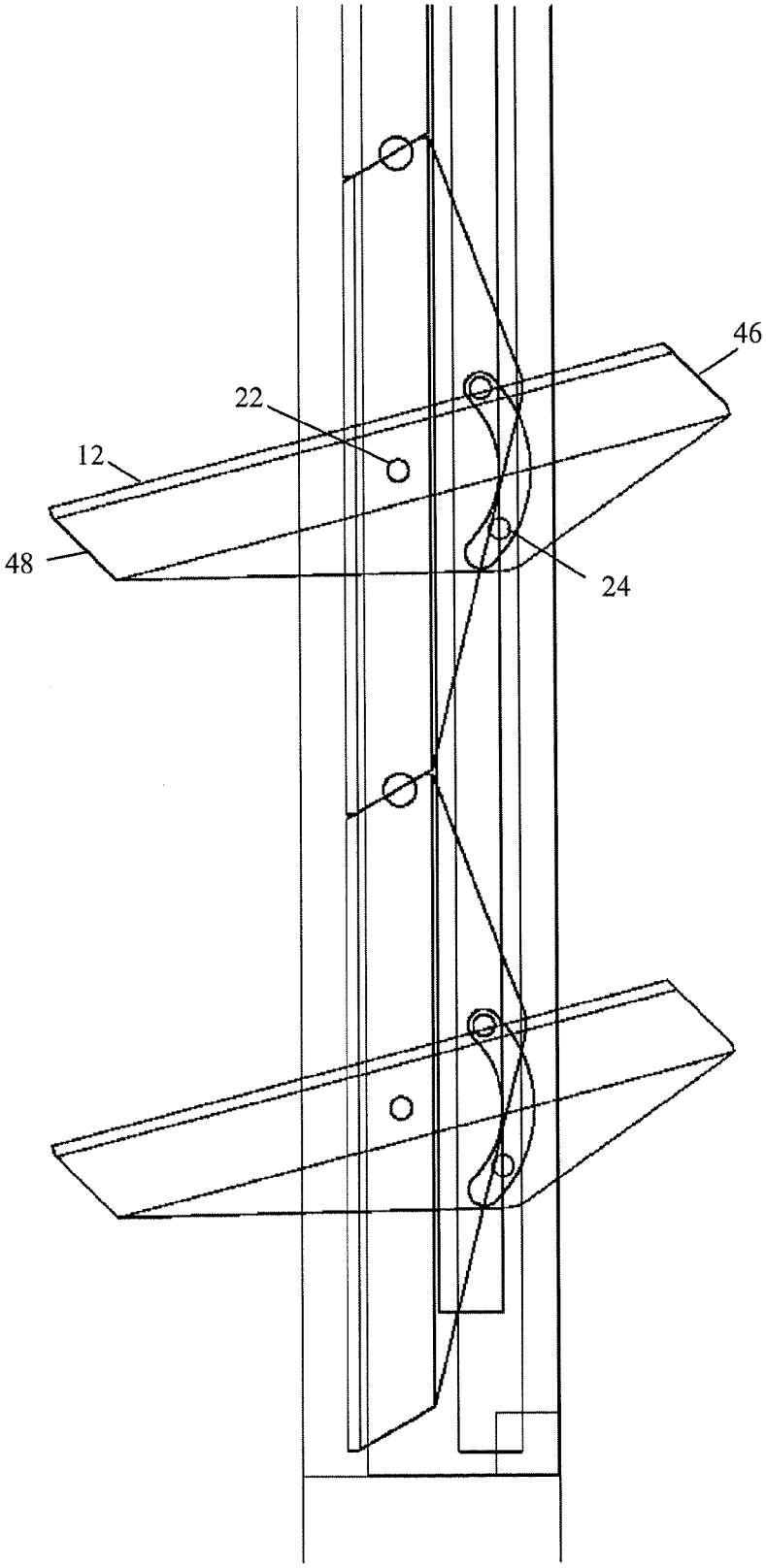
FIG. 4 is an end view of a shutter according to the present invention illustrating the positioning of the louvers in the open and closed positions.
Figure 5:
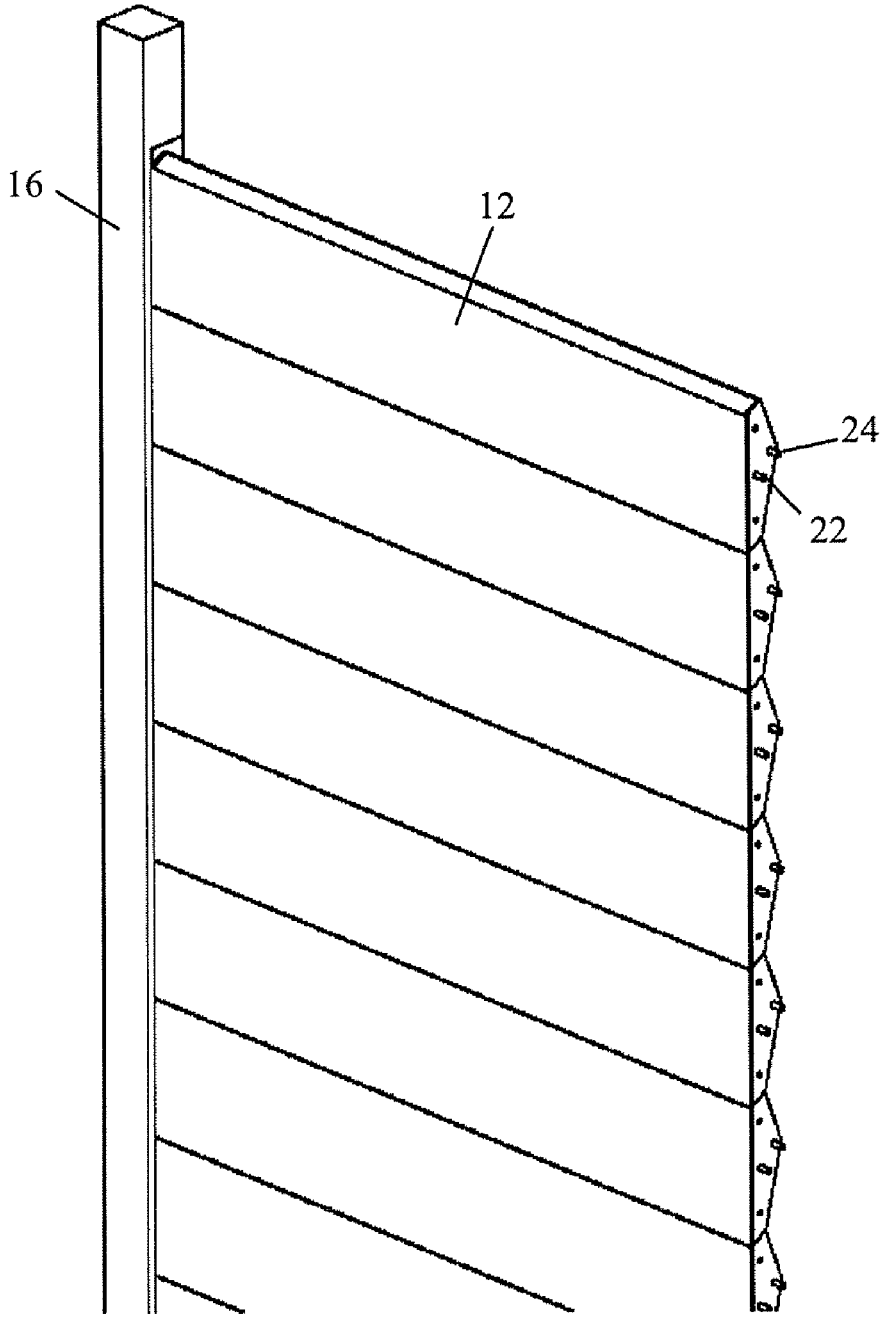
FIG. 5 is a perspective view of a portion of a shutter according to the present invention in the closed position.
Figure 6:
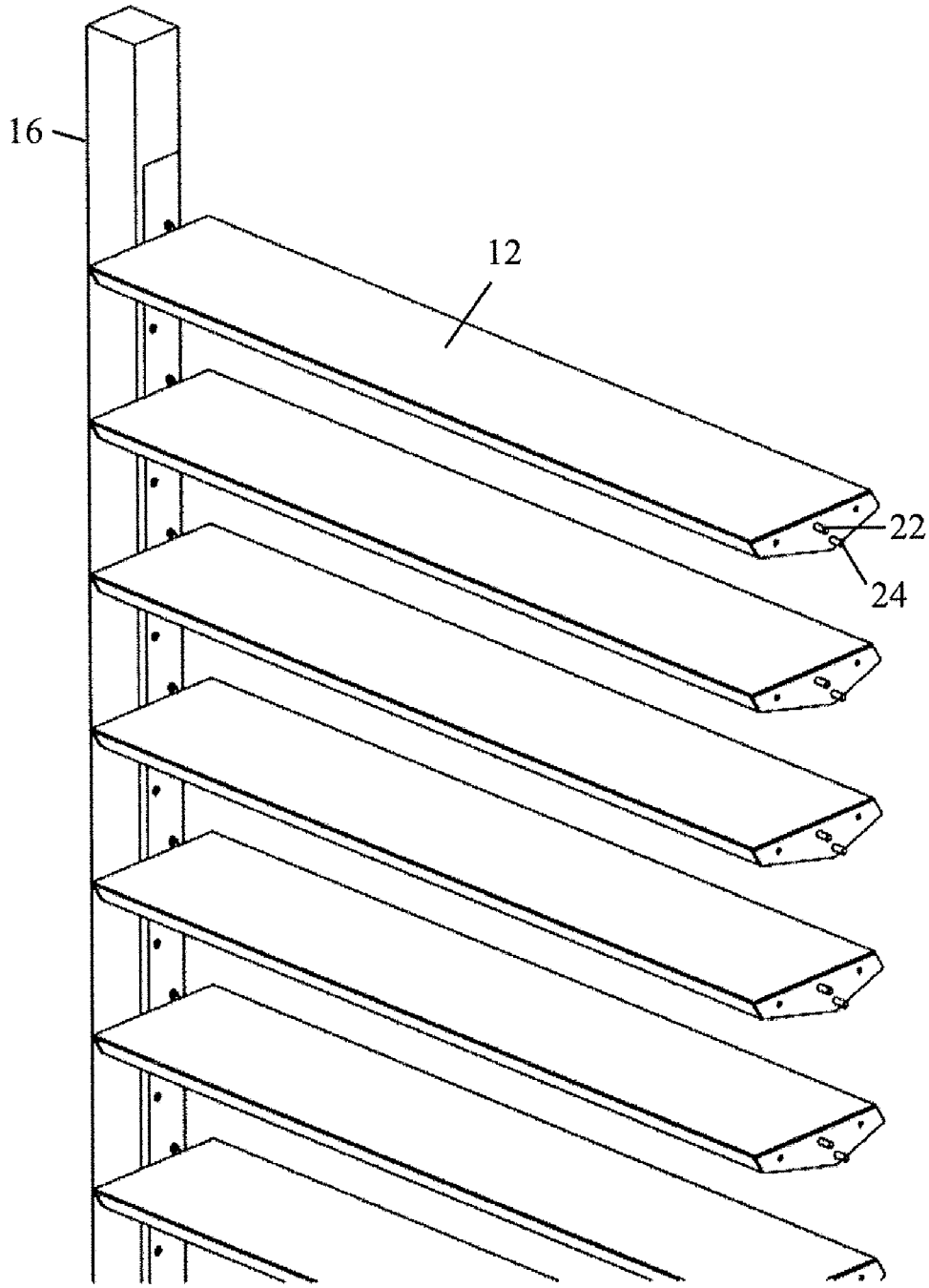
FIG. 6 is a perspective view of a portion of a shutter according to the present invention in the open position.

As seen in FIG. 4, upper edge 46 of each louver 12 is beveled slightly in a predetermined direction, and each lower edge 48 of louver 12 is beveled correspondingly, so that adjacent louvers 12 will not interfere with each other when shutter 10 is opened from the closed position, seen in FIG. 5, or closed from the open position, seen in FIG. 6, and to assist with the alignment of adjacent louvers 12 along common plane A-A when in the closed position. It should be recognized by those of skill in the art that the beveling may be reversed depending on which way louvers 12 are intended to open and how the louvers 12 will overlap in the open position. Although beveled ends are preferred due to their aesthetic appeal, louvers may include a shiplap, ogee, or any other curvature or edge that allows adjacent louvers 12 to lay substantially co-planar. It should be obvious to those of skill in the art that shutters 10 may be custom built to fit into any appropriate location, either singularly or in multiple combinations of shutters 10.

Figure 7:
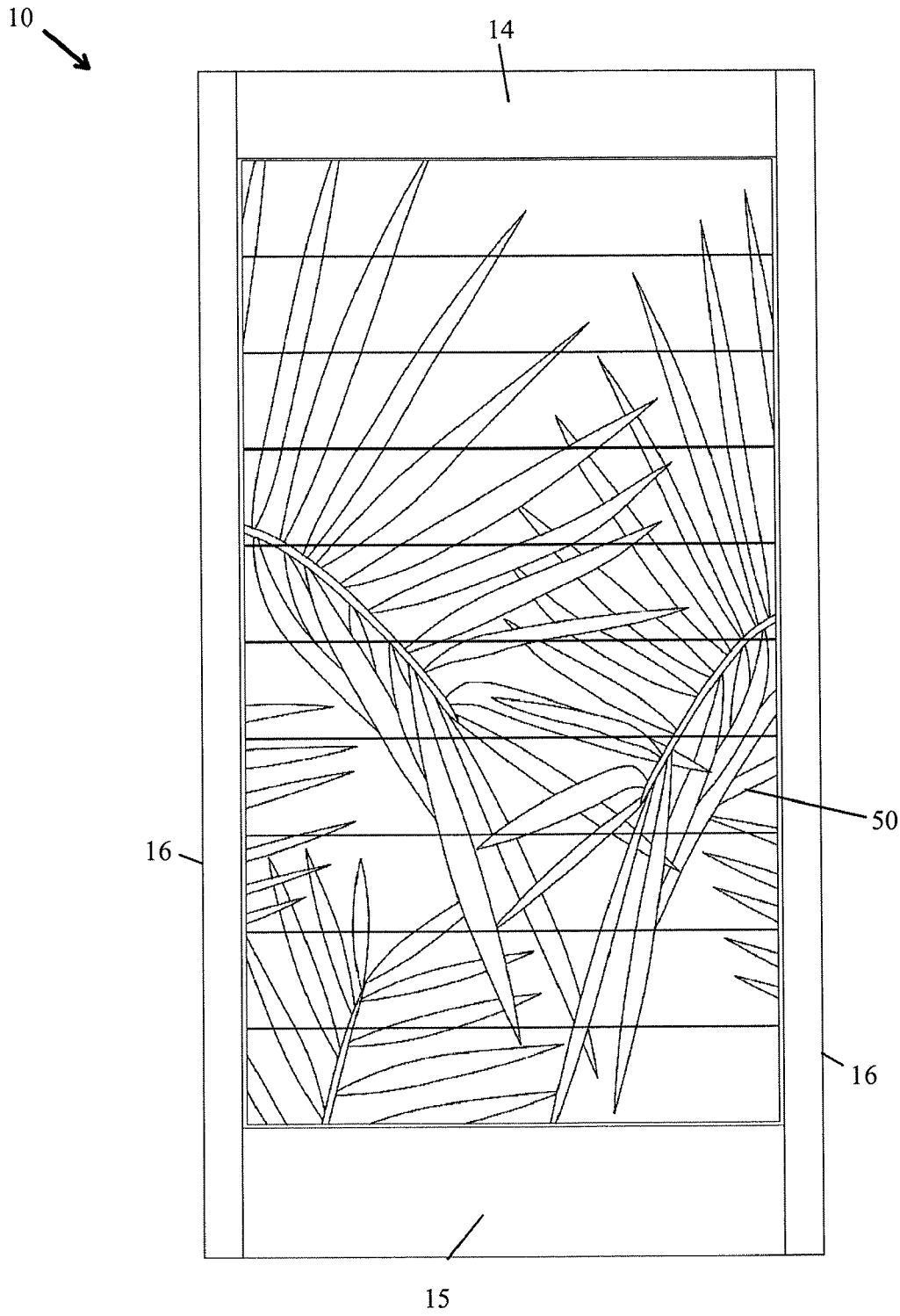
FIG. 7 is a front view of a shutter of the present invention in the closed position that has been decorated according to the present invention.

As seen in FIG. 7, a design 50 may be imprinted or engraved into the surface of louvers 12 to form an attractive image when shutter 10 is closed and louvers 12 present a substantially flat and non-overlapping surface. For example, conventional printing techniques, such as inkjet printing and tampo printing may be used, as well as other methods, such as the use of printed overlays or laminations. Alternatively, louvers 12 may be formed from a material impregnated with a particular design, such as stained glass, or a transparent or opaque plastic material having a design positioned thereon, embedded therein, or formed into the plastic itself.

As an alternative to the preferred driving mechanism comprising one or two control rods 34 interconnected to louvers 12 via offset posts 24, driving mechanism could comprise a series of gears interconnected directly to pivot posts 22. Similarly, driving mechanism could comprise a single pinion gear positioned on the end of each pivot post 22 and an elongated rack, chain, belt or screw could be used to rotate each of the pinion gears simultaneously.

While nearly a full 180 degrees of rotation is possible with the embodiment of the invention of FIG. 1 simply by elongating the arcuate slots 38, when the driving posts 24 reach top or bottom dead center, further movement of the control rod 34 is likely to drive some of posts 24 in one direction and some of posts 24 in the opposite directions, thereby locking louvers 12 in place and preventing smooth rotation between the closed and open positions. Referring to FIGS. 8 through 12, an alternative embodiment of the invention comprises a shutter 60 having a series of louvers 62 extend along common plane A-A which are capable of freely and easily rotating substantially through 180 degrees of rotations. While a full 180 degrees of rotations is theoretically possible, the thickness of louvers 62 will prevent louvers 62 from opening from a fully closed, co-planar position a full 180 degrees to a second, overlapping closed position due to the thickness of the beveled ends when louvers 62 are in the second, overlapping position. Those of skill in the art can readily determine the precise amount rotation by subtracting from 180 degrees the angular component lost due to the particular thickness of a particular style louver 62.

Figure 8:
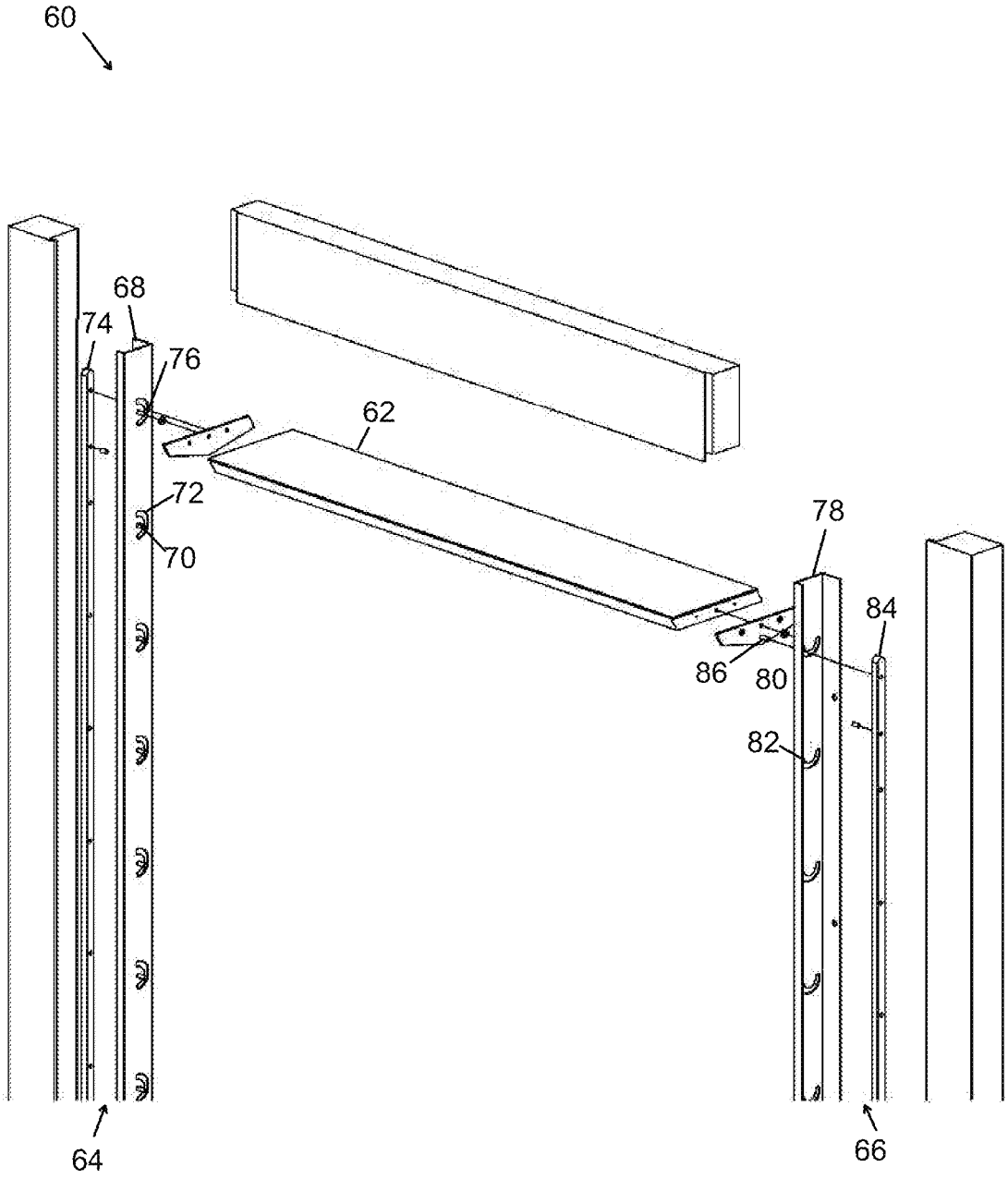
FIG. 8 is an exploded, perspective view of an alternative embodiment of a shutter according to the present invention.

To accomplish full rotation without any locking of louvers 62, shutter 60 includes first and second driving mechanisms 64 and 66 positioned on both side of louvers 62 that are ninety degrees out of phase with each other, as seen in FIG. 8. As described above with respect to the embodiment of FIG. 1, first driving mechanism 64 comprises a first U-shaped bracket 68 with a first pivot pin 70 formed integrally therewith and a first arcuate slot 72 formed therethrough, as well as a first control rod 74 interconnected to louvers 62 via a first post 76 extending through first arcuate slot 72. It should be recognized that pin 70 could be formed separately from bracket 68, formed as part of louver 62, or a separate item. Second driving mechanism 66 comprises a second U-shaped bracket 78 with a second pivot pin 80 formed integrally therewith and a second arcuate slot 82 formed therethrough, as well as a second control rod 84 interconnected to louvers 62 via a second post 86 extending through second arcuate slot 82. To provide for a full 180 degrees of rotation, first arcuate slot 72 and second arcuate slot 82 both extend for 180 degrees, but are positioned (along with their respective posts 76 and 86) ninety degree of out phase with each other. In this manner, the first ninety degrees of rotation of louver 62 are driven by first control rod 74, and the second ninety degrees of rotation are driven by second control rod 84. Thus, whenever post 76 or post 86 reaches top or bottom dead center, any force transmitted to louver 62 will continue to smoothly drive one of the rods, thereby opening or closing the remaining louvers 62 in an efficient and smooth manner.

Figure 9A:
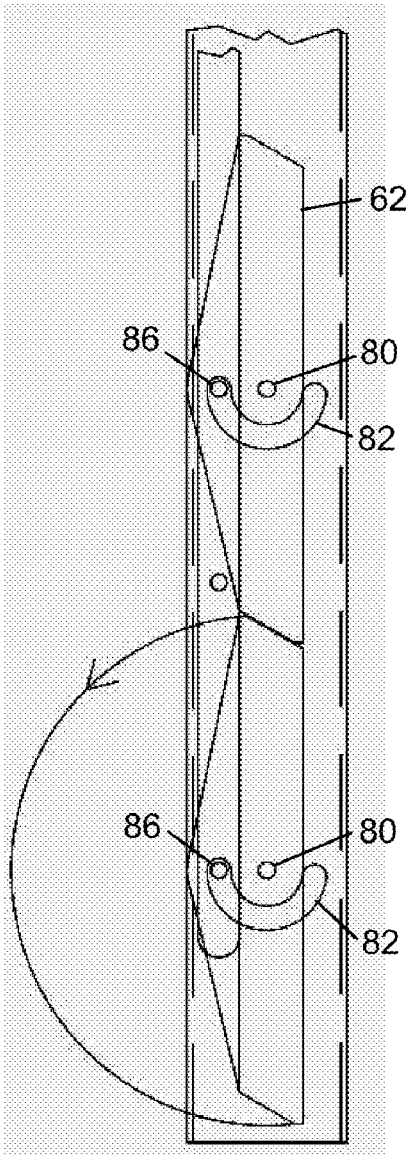
FIGS. 9A and 9B are end views of an alternative embodiment of a shutter according to the present invention in a fully closed position.
Figure 9B:
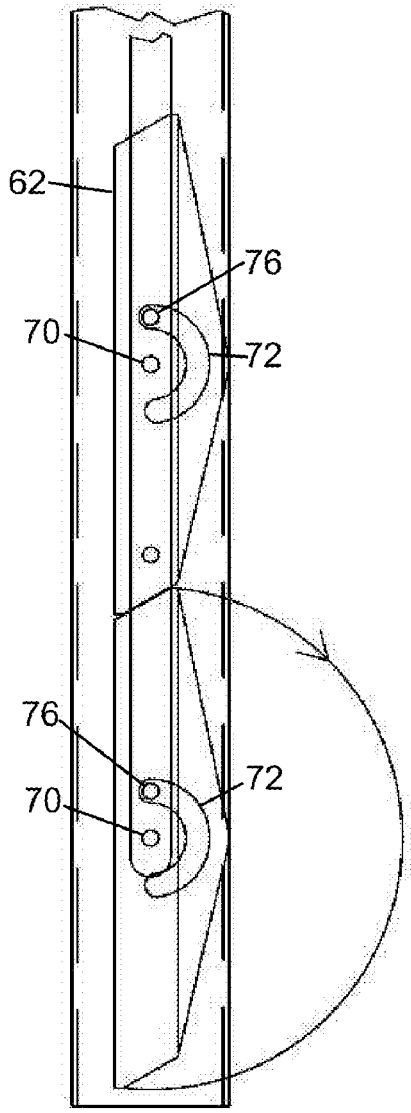
Figure 10A:
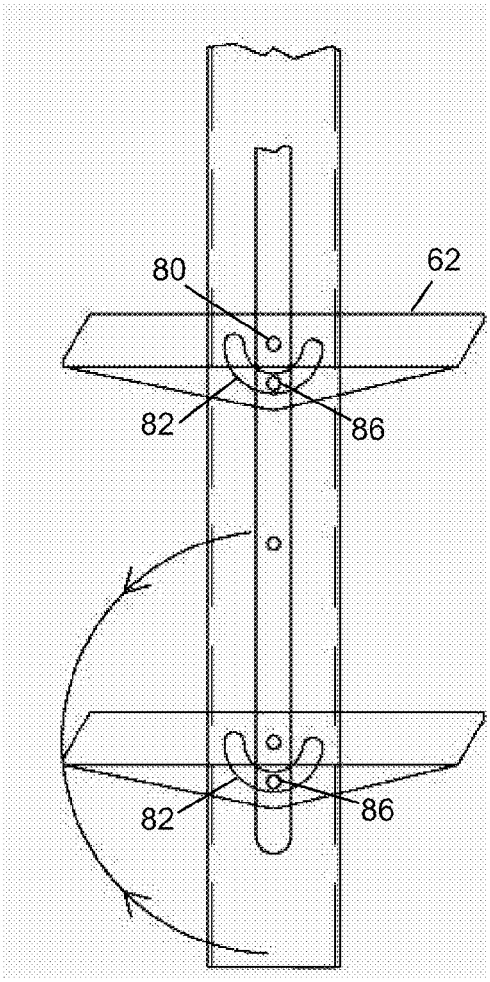
FIGS. 10A and 10B are end views of an alternative embodiment of a shutter according to the present invention in an intermediate position.
Figure 10B:
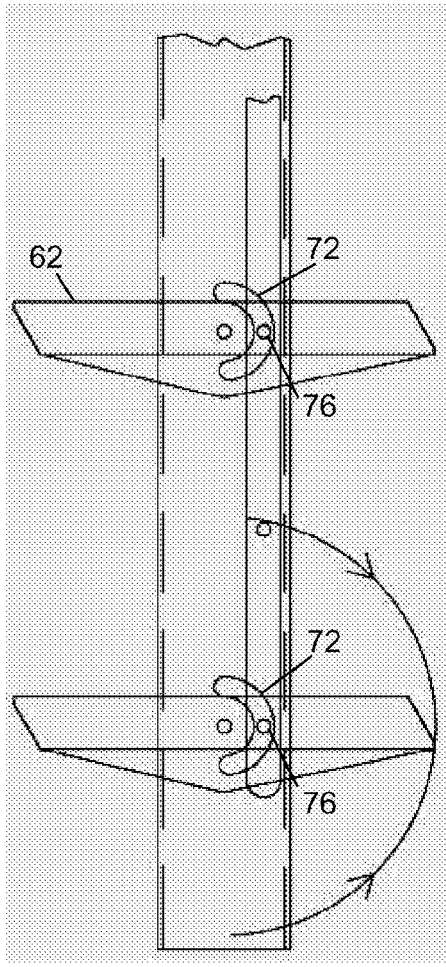
Figure 11A:
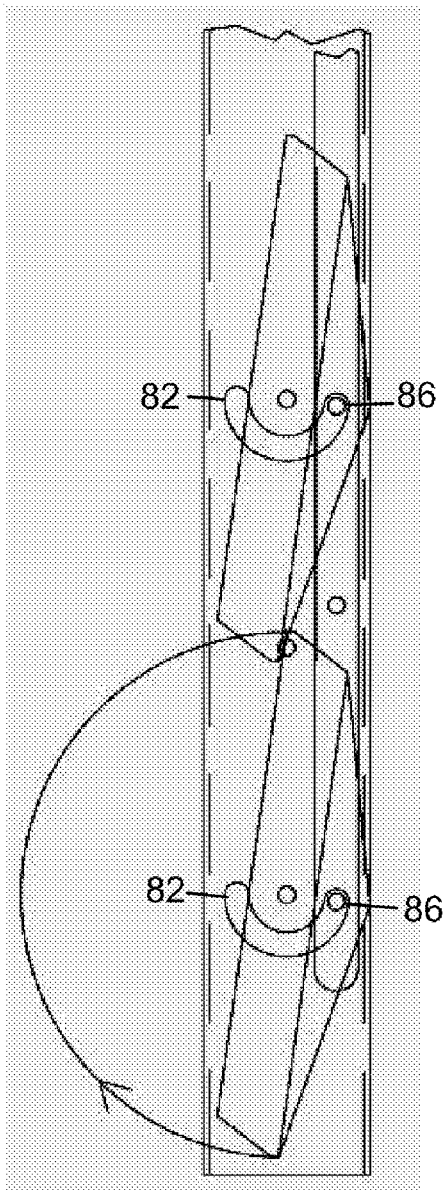
FIGS. 11A and 11B are end views of an alternative embodiment of a shutter according to the present invention in a fully rotated position.
Figure 11B:
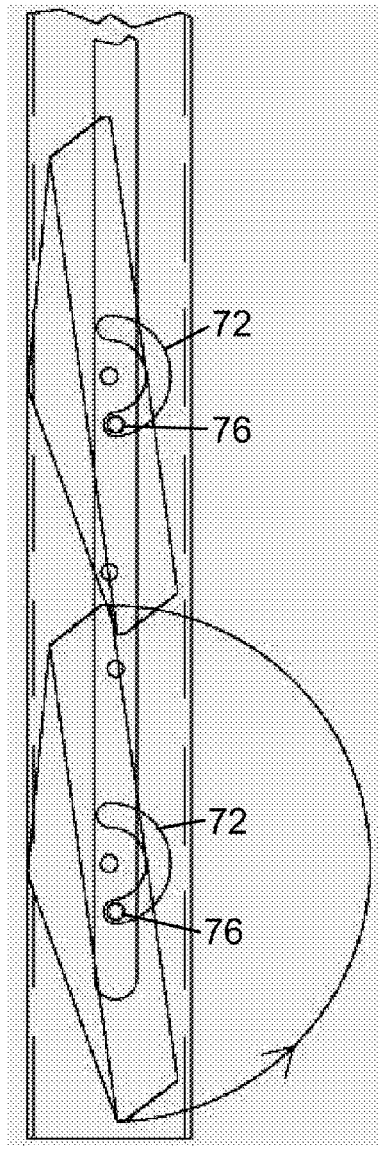
Figure 12:
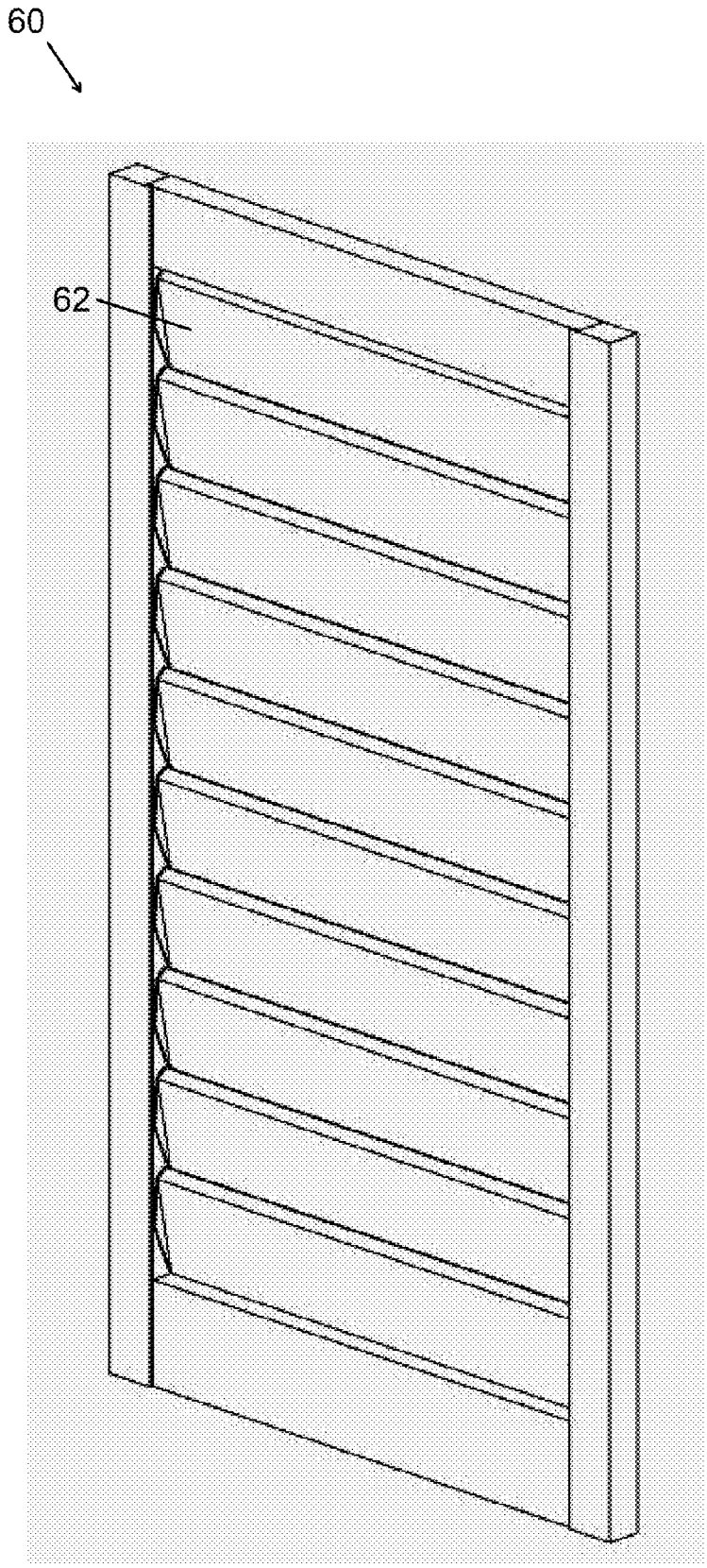
FIG. 12 is a perspective view of an alternative embodiment of a shutter according to the present invention in a fully rotated position.

The movement of louvers 62 through the entire range of rotation may be seen in FIGS. 9-11, with FIGS. 9A, 10A and 11A showing the operation of first driving mechanism 64, and FIGS. 9B, 10B and 11B showing the operation of second driving mechanism 66 which is ninety degrees out of phase with first driving mechanism 64. With respect to FIG. 12, louvers 62 of shutter 60 may be moved through nearly 180 degrees of rotation from a first closed position where louvers 62 are aligned along a single, common place, into a second closed position where louvers 62 are overlapping.

To further improve the smoothness of movement of louvers 62, one or magnets may be positioned to attract first and/or second control rods 74 and 84 in particular locations, such as the positions of rods 74 and 84 that correspond to the fully open and fully closed louver positions, thereby ensuring that louvers 62 are retained in the open and closed positions absent the intentional application of force by a user.

In the preferred embodiments, fabrication of shutter 10 or shutter 60 preferably entails the separate creation of the wooded parts and metal parts. For example, the stiles can be cut to width with a table saw, cut to length with a cutoff saw, milled to configuration with a shaper, and drilled and doweled for assembly purposes. The top and bottom rails may then be cut to width with table saw, cut to length with cutoff saw, milled to configuration with a shaper, and drilled. Assembly of these items involving gluing the dowels and assembling the parts into the configuration discussed above. The louvers may be fabricated by cutting to length with a cutoff saw and then milled with a shaper. The ends of the louver may also be drilled for assembly. All parts may be sanded with a belt sander and finished by paint spraying depending on aesthetic needs. The elements that are preferably formed from metal, such as the rails and end pieces may be separately lasered from stock, cut to the appropriate length and radius, and finished. The metal rails may then be assembled with the wooden frame, the track and pinion parts positioned in place, and the louvers screwed to the end pieces.

What is claimed is:

1. A shutter, comprising:

a plurality of louvers, each of which extends along an axis of rotation from a first end to a second end and includes a first lateral edge and a second lateral edge, wherein said first lateral edge comprises a first bevel extending entirely along a first plane and said second lateral edge comprises a second bevel extending entirely along a second plane that is parallel to said first plane;

a first driving mechanism interconnected to the first end of each of said plurality of louvers at a first point offset from the axis of rotation; and a second driving mechanism interconnected to the second end of each of said plurality of louvers at a second point offset from the axis of rotation, wherein said first point on each of said plurality of louvers is about ninety degrees out of phase with said second point on each of said plurality of louvers relative to rotation about the axis of rotation.

2. The shutter of claim 1, further comprising first and second stiles positioned on either end of said plurality of louvers, wherein said first stile includes a first bracket and said second stile includes a second bracket.

3. The shutter of claim 2, wherein said first bracket includes a first plurality of arcuate slots and said second bracket includes a second plurality of arcuate slots.

4. The shutter of claim 3, wherein said first and second driving mechanisms are interconnected to the first and second ends of said plurality of louvers, respectively, by a first and a second plurality of posts, wherein each of said first plurality of posts extends from said first control rod through one of said first plurality of arcuate slots to the first end of each of said plurality of louvers, and wherein each of said second plurality of posts extends from said second control rod through one of said second plurality of arcuate slots to the second end of each of said plurality of louvers.

5. The shutter of claim 4, wherein said first plurality of arcuate slots are ninety degrees out of phase with said second plurality of arcuate slots relative to the axis of rotation.

6. The shutter of claim 1, wherein said plurality of louvers extend along a common plane when said shutter is in a closed position.

* * * * *